US011370604B1

(12) United States Patent
Gold et al.

(10) Patent No.: US 11,370,604 B1
(45) Date of Patent: Jun. 28, 2022

(54) DISPENSING SYSTEM

(71) Applicants: Gil Gold, Kibutz Shalavin (IL); Tamir Levy, Efrat (IL)

(72) Inventors: Gil Gold, Kibutz Shalavin (IL); Tamir Levy, Efrat (IL)

( * ) Notice: Subject to any disclaimer, the term of this patent is extended or adjusted under 35 U.S.C. 154(b) by 0 days.

(21) Appl. No.: 17/212,632

(22) Filed: Mar. 25, 2021

(51) Int. Cl.
*B65D 88/28* (2006.01)
*B65D 83/06* (2006.01)

(52) U.S. Cl.
CPC ..... *B65D 88/28* (2013.01); *B65D 83/06* (2013.01)

(58) Field of Classification Search
CPC ..... B65D 88/28; B65D 83/06; B65D 88/26; B65D 88/54
USPC ..... 222/185.1, 367, 368, 410
See application file for complete search history.

(56) References Cited

U.S. PATENT DOCUMENTS 2,475,381 A * 7/1949 Erickson ..... B02C 11/04 222/260
2,575,967 A * 11/1951 May ..... A47G 19/34 222/39
4,279,220 A * 7/1981 Kukurba ..... A01K 5/0291 119/51.11
6,607,096 B2 * 8/2003 Glass ..... F25C 5/24 222/14
7,703,639 B2 * 4/2010 Landau ..... B65G 65/4881 222/138
10,512,364 B2 * 12/2019 Chen ..... A47J 42/00
10,588,322 B2 * 3/2020 Hamon ..... A21C 9/04
2013/0082130 A1 * 4/2013 Hulett ..... A47J 42/50 241/291
2013/0299519 A1 * 11/2013 Gold ..... G01F 11/003 222/368
2015/0246742 A1 * 9/2015 Gold ..... G01F 11/003 222/369
2021/0307289 A1 * 10/2021 Baxter ..... A01K 5/0275

* cited by examiner

*Primary Examiner* — Vishal Pancholi
(74) *Attorney, Agent, or Firm* — Arronberg Goldgehn Davis and Garmisa

(57) ABSTRACT

The present invention generally relates to a device that allows for dispensing of products from one or more hoppers. The system utilizes a hopper or hoppers to hold product. An impeller is enclosed within an outlet chute of the hopper. A sensor monitors the area surrounding the port of the outlet chute and, when a receptacle is sensed, the sensor transmits a signal to a controller that in turn controls the operation of a motor to move the impeller and dispense product.

19 Claims, 4 Drawing Sheets

DISPENSING SYSTEM

BACKGROUND

There are a number of dispensing systems currently on the market. One system is described in U.S. Pat. No. 7,703,639, the entirety of which is incorporated herein for all purposes. Such dispensing systems utilize a hopper and an impeller that is manually operated. A user desiring to dispense product from the hopper, turns a handle that is connected to the impeller causing the impeller to rotate and dispense product.

Some of the problems that arise with the use of such systems is that the handle can become soiled through repeated uses by multiple people. That can lead to cross contamination. Additionally, it is not possible for the user to accurately measure, and the supplier to control the amount of product being dispensed. While one serving of a product might correspond to one cup of product, the user is left only with the ability to estimate the output. And if too much is dispensed, the excess is wasted. Additionally, the user can only gauge the dispense of a product based on what the user experiences exiting the system and being deposited in the user's receptacle. It is not possible for the user to accurately determine, nor the supplier to control, the volume of product to be dispensed prior to dispensing the product.

SUMMARY

The present system generally relates to a device that allows for the dispensing of products from one or more hoppers. The system utilizes a hopper or hoppers to hold product. An impeller is enclosed within an outlet chute of the hopper. A sensor monitors the area surrounding the port of the outlet chute and, when a receptacle is sensed, the sensor transmits a signal to a controller that in turn controls the operation of a motor to move the impeller and dispense product. The sensor may be connected to an activation lever (or button), or may be touchless sensor such as a laser or infrared sensor. The touchless sensor may be activated by positioning an object, such as a bowl, beneath the impeller and in proximity to the impeller. For example, with the base sitting on a table, there is a distance between the impeller and the surface of the table or tray beneath the dispensing chute. By placing an object between the impeller and the table or tray, the sensor senses the presence of the object and product is dispensed. It has been found that placement of the object within two to six inches of the impeller (or from the bottom of the chute housing the impeller) generally allows for suitable flow of product without having the product bounce out of the object (e.g. a bowl or other receptacle) or otherwise escape the object.

The controller includes a memory that may store information regarding the product to be dispensed as well as a correlation between the product and the gauge (or segment volume) of the impeller. Thus, as the impeller is rotated through the outlet chute, a known quantity of product will be separated from the hopper and become trapped within a segment of the impeller as the segment is bounded by the outlet chute. As the impeller continues to rotate, the contents of a single impeller segment (e.g. the area between two adjacent blades) is released, and thus a known quantity of product is dispensed. The controller is able to correlate the number of rotations of the impeller with the type of product being dispensed to determine the total amount of product dispensed by the rotation of the impeller. For example, the controller includes a memory that is populated with a value that is a predetermined correlation between the volume of an impeller segment and the amount of a particular product that fits within the segment volume. For example, the memory may include values for hard-shell chocolate candies that one segments equals approximately 1.0 ounces of candies which equals one serving which requires one sixth of a turn of the impeller corresponding to a particular operating time of the motor (e.g. 1 second) at a particular speed (e.g. low speed). The memory may also store a values relating to, for example, puffed rice indicating that one segment holds approximately 0.1 ounces of puffed rice and that 1.4 ounces is a serving requiring 14 one-sixth turns of the impeller for one service corresponding to a particular operating time (e.g. 3 seconds) of the motor at a particular speed (e.g. high speed).

Alternate impellers may be utilized to segment dispenses of product. For example, rather than an impeller with blades, the impeller could be a cylinder with a one or more cavities. Alternately, the impeller could be a ball with one or more indentations or cavities. In each embodiment, the impeller is provided with segments (which could be cavities) that have known volumes and which can be correlated to volumes of a product to be dispensed. As the impeller is rotated, the segments fill with product, separate a volume of product from the bulk of the product in the hopper, and release the volume of the product out the chute.

A sensor is provided to determine when a receptacle is located in the dispensing area. When the receptacle is sensed by the sensor, the sensor transmits a signal to the controller indicating the presence of a receptacle. The controller then transmits a signal to a motor connected to the impeller, causing the motor to turn the impeller. The controller controls the operation of the motor to dispense product. In one embodiment, the controller dispenses product so long as it continues to receive signals from the sensor indicating the presence of a receptacle. In another embodiment, the controller dispenses a predefined amount of product (e.g. 6 segments worth). In such an embodiment, the controller may monitor the input from the sensor such that, if the sensor signal indicates that the receptacle has been removed (for example, the sensor stops sending a signal corresponding to the presence of a receptacle) the controller interrupts the predefined dispense and stops dispensing. However, if the receptacle remains, once the predefined product amount has been dispensed, the controller stops the operation of the motor and no longer dispenses product. The receptacle must then be removed from the dispensing area, which resets the sensor and the controller for a new dispense cycle.

It is further contemplated that the controller may be programed with additional correlating information. For example, products may have known nutritional values. A cereal may have values such as serving size, calories per serving, carbohydrates per serving, sugar per serving, protein per serving, etc. The serving size may be tied to volume. Such values are generally available from the manufacturer. The controller may be programed to store that data. The controller also may be programed to store the volumetric data associated with an impeller segment. Thus, for a given product, the controller may calculate the nutritional information associated with the amount of product that can be dispensed by impeller segments. Prior to a dispense, the controller may receive an input instructing the controller to dispense product according to a set nutritional or other preprogramed quantity of product. For example, one dispense cycle may be limited to product containing 200 calories. Another dispense cycle may be limited to product containing 15 grams of sugar. Another may be strictly volume based such that the dispense cycle is limited to one cup of product. The controller utilizes known, stored, properties of the product and the known, stored, volumetric data associated with an impeller segment to determine how many segments must be rotated through the chute to correctly dispense product. When a receptacle is present, the controller sends a signal to the motor which then turns the impeller the correct number of times to dispense the product from the proper number of segments before stopping (thus completing a dispense cycle). The number of times that the impeller rotates can be stored in memory and that data may be used to correlate to the volume of product dispensed. The controller may transmit data relating to the volume of product dispensed to, for example, a PC or other networked device that may further utilize the data for inventory management. By knowing how much product was dispensed, the owner can determine (or be alerted to) when it may be necessary to refill the hoppers.

DETAILED DESCRIPTION OF PREFERRED EMBODIMENTS

Figure 1:
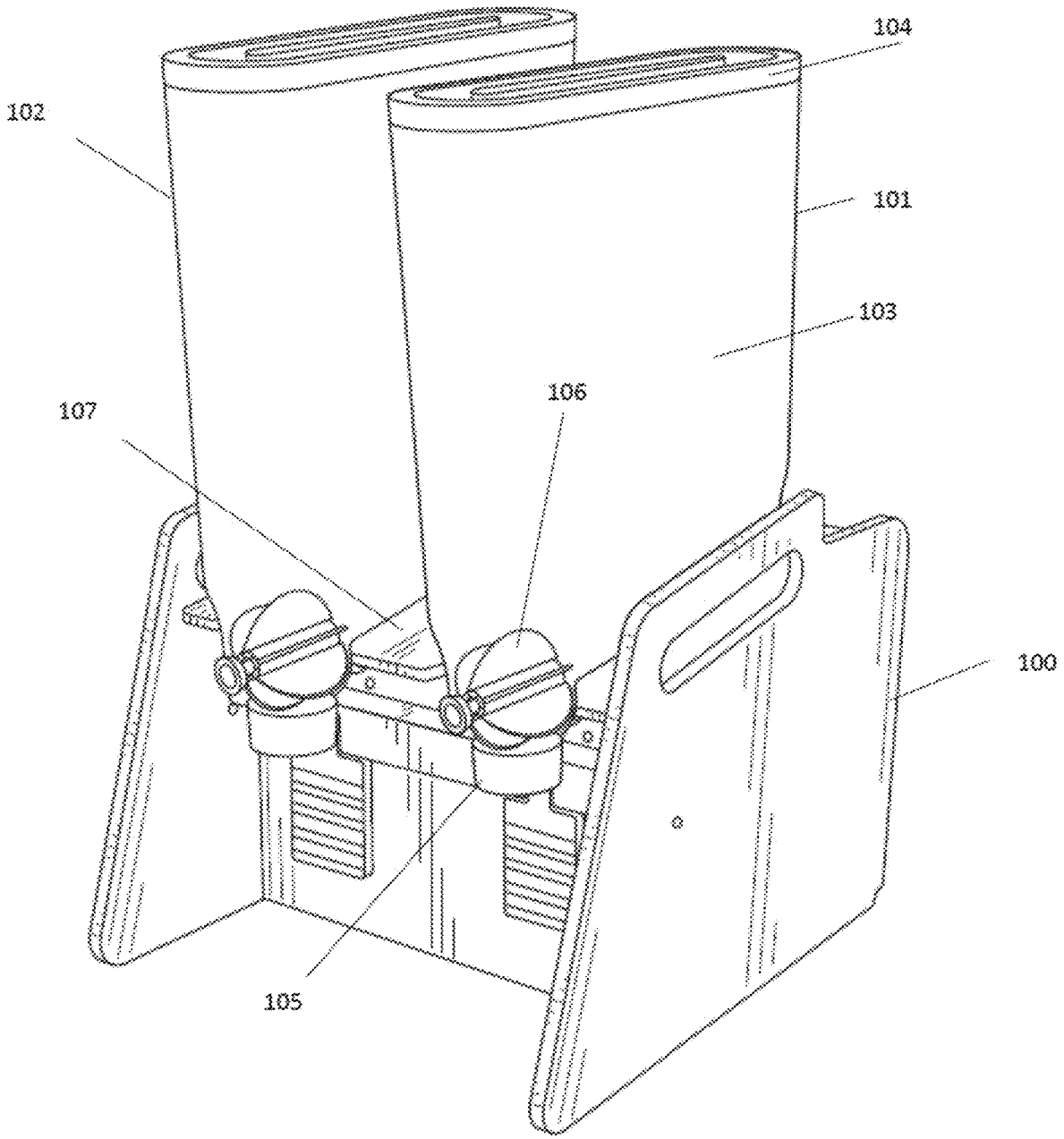
FIG. 1 is a perspective view of one embodiment of a dispensing system.

The preferred embodiments of the present invention are described with reference to the drawings below. In the drawings, like numbers are used to refer to like elements. Unless otherwise stated, "and" is conjunctive, while or is disjunctive and conjunctive such that the condition "A or B" is satisfied by any of "A" alone, "B" alone, and "A and B" together.

Referring to FIG. 1, a dispensing system may include a housing 100 and one or more hoppers 101, 102. For explanatory purposes, the structure of one hopper is discussed herein, and it should be understood that any plurality of hoppers could be provided, each having substantially the same structure. Hopper 101 includes a hopper cavity 103 with an access port 104 (such as a removable/openable lid). The hopper is capable of holding a quantity of product (not shown) to be dispensed.

The hopper includes an outlet chute 105 housing an impeller 108. The chute of the hopper may be circular in cross section. With the impeller positioned inside, a pin may pass through the hopper sidewall, through the impeller, and out the opposite sidewall. The outlet chute and impeller are matched in size such that the impeller blocks product in the hopper from free-flowing through the outlet chute when the impeller is stationary. The output chute may simply be a hole, but may also extend down from the impeller to further funnel product dispensed from the hopper. In one embodiment, the hopper may include a base 107. In the embodiment depicted the base slants toward the impeller and thereby utilizes gravity to assist in funneling product in the hopper toward the impeller. The housing also includes a motor connected to the impeller and to a controller.

Figure 3:
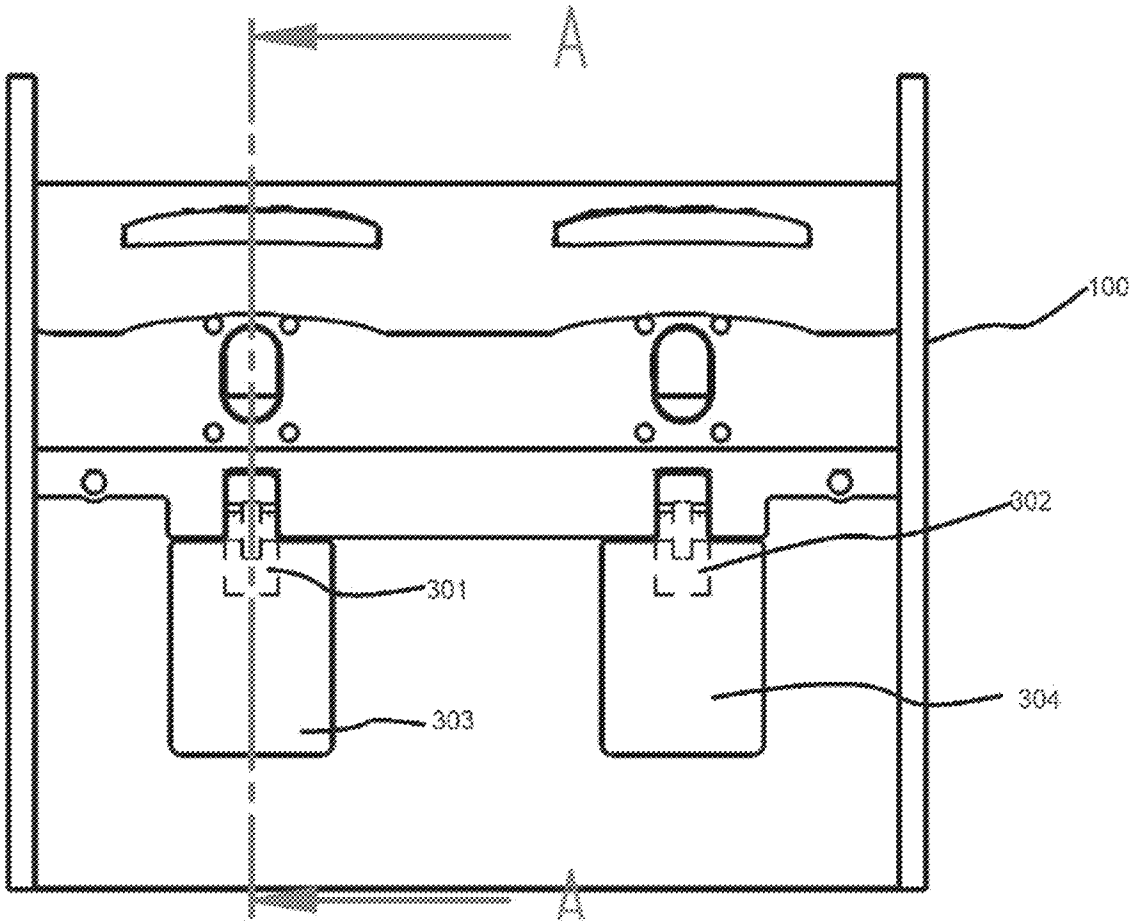
FIG. 3. Is a front plan view of the base of a dispensing system.
Figure 4:
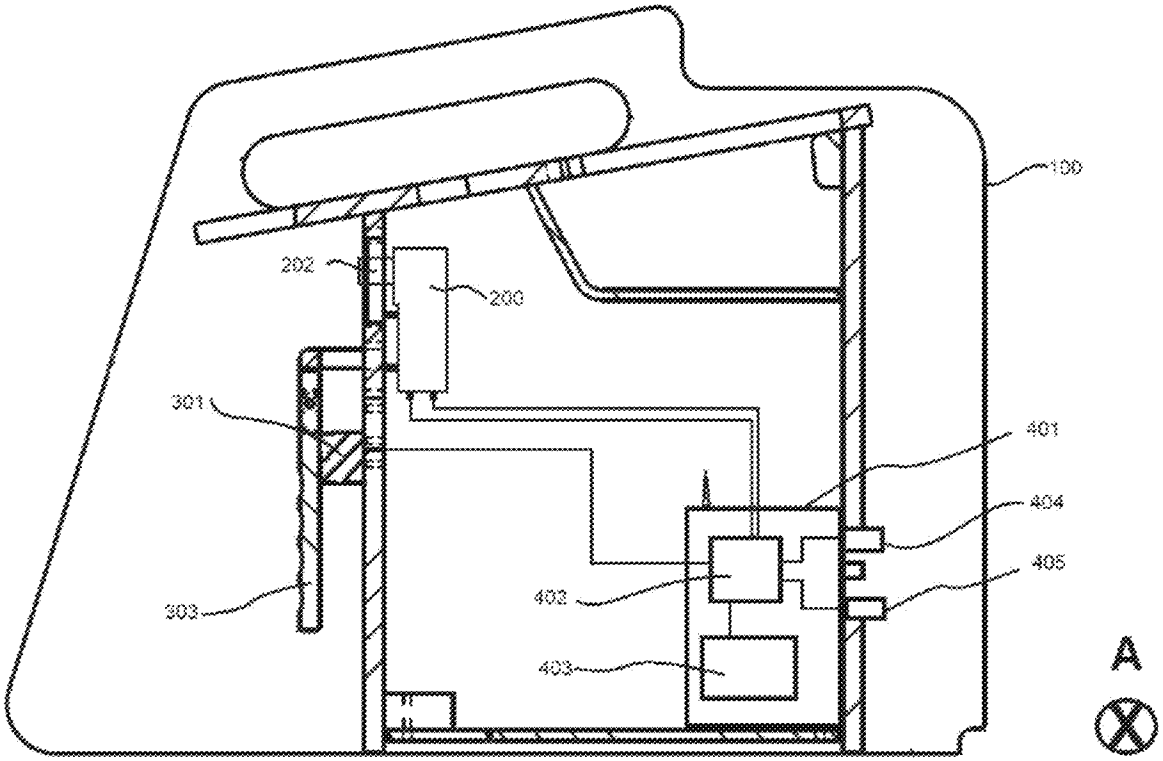
FIG. 4 is a cross-sectional view along line A of FIG. 3 of the base of a dispensing system.

As shown in FIG. 4, a cross-sectional view of the housing 100 along line AA in FIG. 3, a controller 401 is provided within the housing 100 (and it may also be referred to as the base controller). In one embodiment, the base controller is a hardware circuit. In a another embodiment, the base controller is a microprocessor based controller having a processor 402, inputs, outputs, and a memory 403 that stores executable computer code, gathered data, and predetermined data, such as data respecting the operation of the controller, the volume of a an impeller segment, or nutritional or volumetric data respecting a product that may be in the hopper. The base controller may also be connected to external controller(s) such as computer components, such as through wi-fi, Bluetooth, LAN line, or other electrical connection. In such an embodiment, the function of the controller may be distributed across a local controller housed within the base and one or more external computer systems.

In one embodiment, the controller is coupled with one or more switches (404, 405) affixed to the base, such as at the back of the base. The switches may correspond to on/off times and speed times for each motor. For example, one switch may have a 2 second position and a 4 second position, and another switch may have a low speed position and a high speed position. Each switch may be associated with a single motor. The controller controls the operation of the motor when a sensor is activated according to the positions of the switches. Thus, an operator may set the switches to 2 seconds, slow for one type of products, causing the motor to turn the impeller for 2 seconds at a slow speed when the sensor senses an object, or the operator may set the switches for 2 seconds fast, causing the motor to turn the impeller for two seconds at a fast speed when the sensor senses an object, etc.

Alternatively, where the controller is connected to one or more additional controllers (for example a PC, server, tablet, etc.) through the Internet, an operator may use an interface to select the type of product being dispensed. Through empirical determination, the volume of a particular product to be dispensed upon a single sensor activation (i.e. how long to activate the motor at what speed to dispense a particular volume based on impeller segment size) can be known and pre-stored in memory (such as at the time of manufacture of the device or uploaded prior to dispensing product), either locally at the base or on the PC. The operator can set the type of product to be dispensed, and the controller can then appropriately control the operation of the motor based on the predetermined, stored, empirical data respecting the product to be dispensed. For example, one serving of corn flakes may require 15 turns over 5 seconds to prevent excessive breakage, while one serving of granola may be dispensed for 10 turns over 2 seconds.

Figure 2:
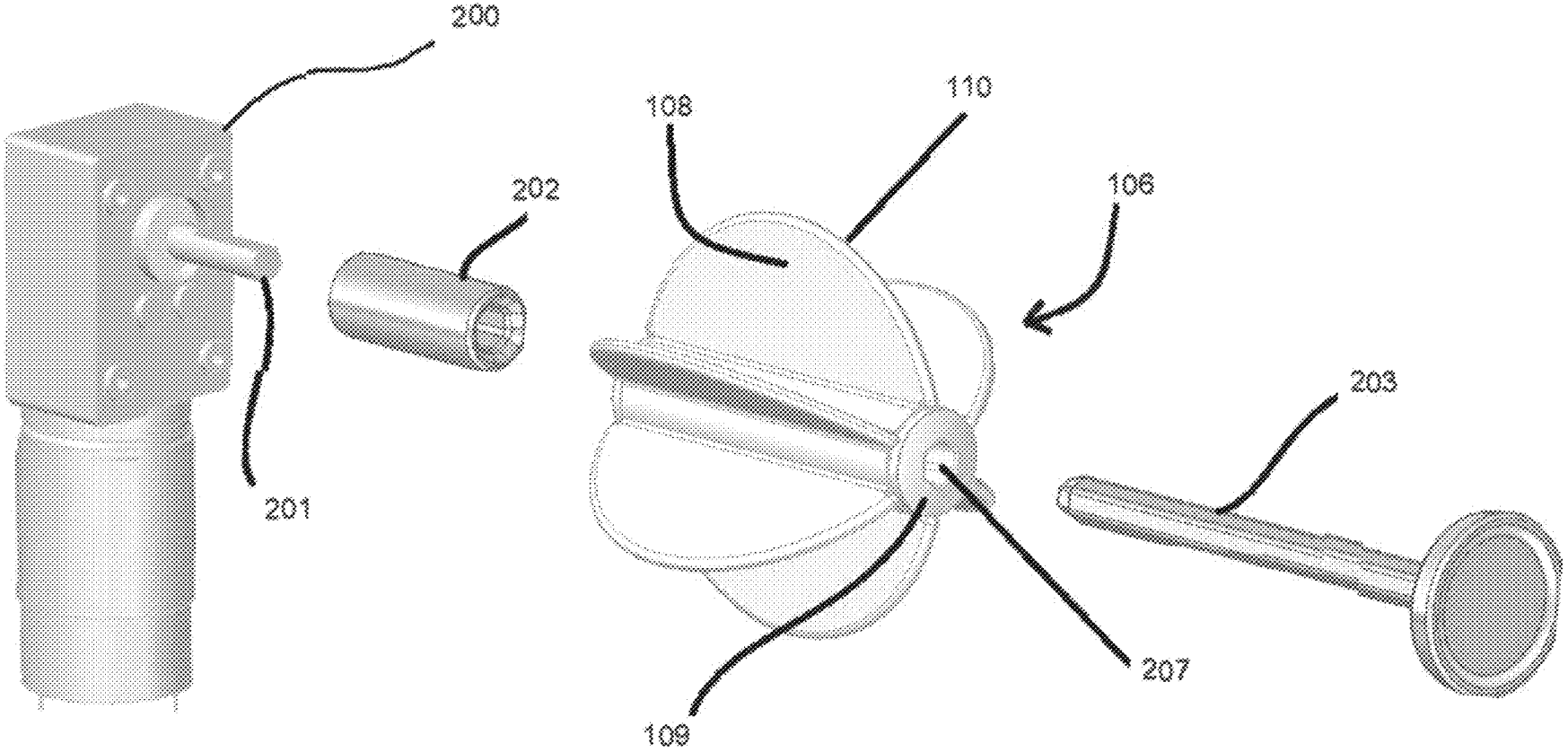
FIG. 2 is an exploded view of the dispensing portion of a dispensing system.

Referring to FIG. 2, the motor 200 includes an output shaft 201. In one embodiment, the output shaft is axially aligned with a center axis of the impeller 106. In the embodiment of FIG. 2, the shaft 201 and impeller 106 are joined by a collar 202. The impeller 106 includes an axial tube that accommodates a ridged tubular shaft 109 that surrounds and forms an axial cavity 107. The tubular shaft connects to the impeller (or may be integrated with the impeller) such that as the tubular shaft rotates, the impeller rotates. An impeller pin 203 may be inserted through axial cavity 107 of the tubular shaft to engage with the collar 202 and the impeller and thereby couple the impeller to the motor. In one embodiment, collar, tubular shaft, and impeller are each keyed such that the impeller pin engages the collar and tubular shaft. Such a coupling allows the impeller pin to be repeatedly coupled and decoupled from the motor and impeller. In one embodiment, the coupling is accomplished though simple frictional engagement and without the need for tools. In one embodiment, the impeller pin and the interior of the axial cavity 107 of the impeller are formed of non-circular, mating mirror images, such as a hexagon, so as to mechanically engage with one another. For example, the axial cavity and pin may each be square or triangular in cross-section. In FIG. 2, the axial cavity and pin are each shaped in cross section such that the pin keys with the axial cavity.

The impeller may include a plurality of blades 108 extending from the center of the impeller. The blades may be made of a flexible material such as silicone or rubber having sufficient stiffness to move product within the hopper, but flexible enough to prevent breakage of the product when in use. The edge 110 of each blade is shaped to correspond to and mate with a sidewall of the outlet chute. Thus, for a circular outlet chute as shown, the blade edge 110 is semi-circular. The space between two adjacent blades forms a segment of the impeller. In another embodiment, the impeller may include one or more cavities. For example, the impeller may be cylindrical with cavities (which are simply an alternative form of a segment) carved into the body of the cylinder. Such impellers are useful for dispensing small particulate matter, such as powders. In either case, the segments correspond to a volume of product to be dispensed by the impeller as the impeller rotates.

The motor may be fixed within the housing. The outlet chute may include a hole to accommodate the collar and another hole on the opposite side to accommodate the impeller pin. The impeller is placed within the outlet chute and the pin is inserted through the hole in the outlet chute, through the axial cavity 107 of the impeller and into the collar to hold the impeller within the outlet chute and connect the impeller to the motor.

A sensor is associated with each motor. The sensor senses the presence of a receptacle (or object) placed near the outlet chute, such as, below the chute. In one embodiment, the sensor may be a pressure switch. For example, in FIG. 3, sensors 301 and 302 are associated with contact plates 303 and 304 respectively. When a receptacle is pressed against the contact plate 303, thereby applying force to the contact plate, the contact place activates sensor 301. The controller reads the sensor activation and powers the associated motor, causing the impeller to turn and dispense product from the associated hopper. It should be understood that alternative contact plates could be utilized, such a levers, bars, buttons or another force-activated contact.

In another embodiment, suitable sensor are infrared sensors and proximity sensors. Such sensors sense the presence of a receptacle without requiring physical contact. When the sensor senses a receptacle, the sensor transmits a signal to the controller. The controller then transmits a signal to the associated motor and causes the motor and impeller to rotate to dispense product. The controller may be programed to operate according to a particular cycle, such as rotating a set number of segments corresponding to a correlated volume of product, such as the number of segments corresponding to one serving of product, or corresponding to a set caloric value of product. Once the cycle has been reached, the controller stops the motor. In another embodiment, the controller operates the motor as long as the sensor indicates the receptacle is present. The controller can interrupt a cycle in the event that the sensor stops sensing the presence of a receptacle.

The cycles may be preset in the controller. In a further embodiment, the cycles may be changed by a user. For multiple hoppers, one or more controllers may operate the motors. For different products, different cycles may be programed. In one embodiment, a user may select a particular value of product to be dispenses, for example two cups. The controller calculates the appropriate number of segments corresponding to two cups based on a preprogramed corresponding segment volume and the preprogramed data respecting the product to be dispensed (i.e. the correlation between the volume of the segment and the properties of the product) and operates the motor accordingly. Because the dispenser dispenses dry goods, average volume of a product that will fit within the known volume of an impeller segment may be empirically determined and utilized in the control of the system to approximate a desired output volume. The housing may be equipped with input buttons (not shown) to permit a user to change the value of product. In another embodiment, the controller may be connected to the internet and the user may select the value of product using an app. Alternatively, the user may use nearfield communication and an app to change the value of product to be dispensed. In such an embodiment, multiple users may select differing values of product, and the controller utilizes information regarding the product and the volume of the segments to determine the proper cycles to dispense the proper amount. For example, a first user selects one cup of product on a phone, uses nearfield communication to transmit the request to the controller, places a receptacle below the outlet, and the controller cycles appropriately to dispense one cup. The next user selects 200 calories and uses nearfield communication to transmit the request to the controller. The controller correlates the volume of the segment and the type of product to calculate the number of cycles to approximate 200 calories of the product, then dispenses that amount by cycling the impeller when the sensor indicates a receptacle is appropriately located.

Thus, the hopper is able to dispense desired quantities of product by correlating stored values of the products in the hopper with drive conditions for the motor and impeller associated with that hopper. Operators can alter the dispensing cycles though the manipulation of switches or through interfacing with the controller, for example through a remote user interface associated with a computer, or through an app on an internet connected device. The system is thus able to accurately dispense a desired amount of product even, for example, when the user is unaware of the particular nutritional value of the product or the volume corresponding to the nutritional value of a product being dispensed.

The controller may also log the number of dispenses of product, such as by logging the number of rotations (or partial rotations) of the impeller. Because the volume of the hoppers is known, the controller may correlate the number of dispenses to an approximate volume of product that has been dispensed. Once the number of dispenses corresponding to a threshold volume is reached (such as a value that corresponds to three-quarters of the hopper volume being dispensed) the controller may trigger an alert to inform an operator that the hopper is getting low. For example, the controller may use wi-fi to transmit a low-hopper condition to a remote operator computer, identifying the hopper and the type of product contained and thereby signal the operator to refill or reorder the product.

Although the present invention has been described in terms of the preferred embodiments, it is to be understood that such disclosure is not intended to be limiting. Various alterations and modifications will be readily apparent to those of skill in the art. Accordingly, it is intended that the appended claims be interpreted as covering all alterations and modifications as fall within the spirit and scope of the invention.

What is claimed is:

1. A dispenser comprising:

a base;

a hopper having a volume suitable for holding a product to be dispensed;

a base controller having a memory;

a motor connected to the base controller and associated with the hopper;

an impeller housed within the hopper, the impeller including a tubular shaft and at least one segment, an impeller pin coupled to the tubular shaft and to the motor;

a motor shaft connected to the motor, a collar having a proximal end connected to the motor shaft and a distal end having a cavity; and a sensor associated with the motor and connected to the base controller such that upon activation, the sensor transmits a signal to the base controller;

wherein the motor is housed within the interior of the base such that the collar is coaxially aligned with the tubular shaft of the impeller;

wherein the impeller pin is coupled to the distal end of the collar within the cavity such that the impeller pin passes through a first sidewall of the hopper, through the tubular shaft of the impeller, and through a second sidewall of the hopper before coupling to the cavity; and wherein the memory stores data regarding a speed at which to operate the motor upon receipt of a signal from the sensor and data regarding the duration to operate the motor upon receipt of the signal from the sensor such that, in response to receipt of the signal, the base controller automatically controls the operation of the motor to rotate the impeller based on the data regarding speed and the data regarding the duration.

2. The dispenser of claim 1 wherein the impeller pin is coupled by frictional engagement to the distal end of the collar within the cavity.

3. The dispenser of claim 1 further comprising:

a speed switch connected to the base controller and adapted to set the base controller to operate the motor at one of at least two preset speeds; and a duration switch connected to the base controller and adapted to set the base controller to operate the motor for one of at least two preset durations.

4. The dispenser of claim 1 wherein the motor is positioned entirely externally from the volume of the hopper.

5. The dispenser of claim 1 wherein the base controller is housed within the base.

6. The dispenser of claim 1 further comprising a contact plate connected to the base controller wherein the sensor is activated by the application of force to the contact plate.

7. The dispenser of claim 1 wherein the sensor is a touchless sensor positioned such that the sensor is activated by the placement of an object placed beneath and in proximity to the impeller.

8. The dispenser of claim 1 further comprising:

a second controller located externally from the base and connected to the base controller;

the base controller is adapted to receive signals from the second controller relating to one or more of a duration to operate the motor, a speed to operate the motor, and characteristics of a product to be dispensed.

9. The dispenser of claim 1 wherein the base controller stores in memory data values correlating one or more characteristics of a product to be dispensed and the volume of at least one of the segments of the impeller.

10. The dispenser of claim 9 wherein the characteristics of the product to be dispensed are one or more of a) an estimated volume of the product that fits within at least one of the segments of the impeller;

b) an estimated weight of the product that fits within at least one of the segments of the impeller;

c) an estimated nutritional value of the product that fits within at least one of the segments of the impeller.

11. The dispenser of claim 10 wherein the base controller is configured to receive a signal relating to at least one of the characteristics of the product to be dispensed, calculate one or more of the speed and duration to operate the motor based on the signal received, and operate the motor according to that calculation upon receipt of a signal from the sensor.

12. A dispenser comprising:

a base;

a hopper having a volume suitable for holding a product to be dispensed;

a base controller;

a motor connected to the base controller and associated with the hopper;

at least one switch configured to set the base controller to operate the motor at either one of at least two speeds of operation of the motor or one of at least two durations of operation of the motor;

an impeller housed within the hopper, the impeller including a tubular shaft and at least one segment, an impeller pin coupled to the tubular shaft and to the motor; and a sensor associated with the motor and connected to the base controller such that upon activation, the sensor transmits a signal to the base controller;

wherein the base controller is configured to operate the motor upon receipt of a signal from the sensor and the position of the at least one switch such that, in response to receipt of the signal, the base controller automatically controls the operation of the motor to rotate the impeller based on the setting of the at least one switch.

13. A dispenser as in claim 12 wherein the at least one switch comprises a speed switch having a low speed setting and a high speed setting.

14. A dispenser as in claim 13 wherein the at least one switch comprises a duration switch having a first duration setting and a second duration setting that it different from the first duration setting.

15. A dispenser as in claim 12 wherein the at least one switch comprises a speed switch having a low speed setting and a high speed setting and a duration switch having a first duration setting and a second duration setting that it different from the first duration setting wherein the base controller controls the operation of the motor based on both the settings of the speed switch and the duration switch.

16. A dispenser comprising:

a base;

a hopper having a volume suitable for holding a product to be dispensed;

a base controller having a memory;

a motor connected to the base controller and associated with the hopper;

an impeller housed within the hopper, the impeller including a tubular shaft and at least one segment, an impeller pin coupled to the tubular shaft and to the motor;

a sensor associated with the motor and connected to the base controller such that upon activation, the sensor transmits a signal to the base controller;

a speed switch connected to the base controller and adapted to set the base controller to operate the motor at one of at least two preset speeds; and a duration switch connected to the base controller and adapted to set the base controller to operate the motor for one of at least two preset durations;

wherein the memory stores data regarding a speed at which to operate the motor upon receipt of a signal from the sensor and data regarding the duration to operate the motor upon receipt of the signal from the sensor such that, in response to receipt of the signal, the base controller automatically controls the operation of the motor to rotate the impeller based on the data regarding speed and the data regarding the duration.

17. The dispenser of claim 16 wherein the sensor is a touchless sensor positioned such that the sensor is activated by the placement of an object placed beneath and in proximity to the impeller.

18. The dispenser of claim 16 wherein the base controller stores in memory data values correlating one or more characteristics of a product to be dispensed and the volume of at least one of the segments of the impeller.

19. The dispenser of claim 18 wherein the characteristics of the product to be dispensed are one or more of a) an estimated volume of the product that fits within at least one of the segments of the impeller;

b) an estimated weight of the product that fits within at least one of the segments of the impeller;

c) an estimated nutritional value of the product that fits within at least one of the segments of the impeller.

* * * * *